US006896048B2

(12) United States Patent
Mason et al.

(10) Patent No.: US 6,896,048 B2
(45) Date of Patent: May 24, 2005

(54) ROTARY SUPPORT TABLE

(75) Inventors: David Mason, Anaheim, CA (US); Anton Krijnen, Klundert (NL); René Mulder, Etten-Leur (NL)

(73) Assignee: Varco I/P, Inc., Orange, CA (US)

( * ) Notice: Subject to any disclaimer, the term of this patent is extended or adjusted under 35 U.S.C. 154(b) by 0 days.

(21) Appl. No.: 10/325,184

(22) Filed: Dec. 20, 2002

(65) Prior Publication Data

US 2003/0150647 A1 Aug. 14, 2003

Related U.S. Application Data

(60) Provisional application No. 60/342,998, filed on Dec. 21, 2001.

(51) Int. Cl.[7] ..... E21B 3/04

(52) U.S. Cl. ..... 166/78.1; 175/195

(58) Field of Search ..... 166/380, 84.1, 166/84.4, 78.1, 195; 175/195; 464/163; 277/401, 408, 928

(56) References Cited

U.S. PATENT DOCUMENTS

| | | | | |
|---|---|---|---|---|
| 2,570,039 A | | 10/1951 | Stone | |
| 2,641,816 A | | 6/1953 | Liljestrand | |
| 2,939,683 A | | 6/1960 | Spiri | |
| 3,210,821 A | | 10/1965 | Spiri et al. | |
| 3,270,389 A | | 9/1966 | Kingsbury | |
| 3,457,605 A | | 7/1969 | Kingsbury et al. | |
| 3,961,399 A | | 6/1976 | Boyadjieff | |
| 3,999,260 A | | 12/1976 | Stuckey et al. | |
| 4,253,219 A | | 3/1981 | Krasnov | |
| 4,333,209 A | | 6/1982 | Herst | |
| 4,480,703 A | | 11/1984 | Garret | |
| 4,529,045 A | * | 7/1985 | Boyadjieff et al. | 173/164 |
| 4,593,914 A | * | 6/1986 | Johnson | 277/322 |
| 4,754,820 A | | 7/1988 | Watts et al. | |
| 4,872,517 A | * | 10/1989 | Shaw et al. | 173/218 |
| 5,022,472 A | | 6/1991 | Bailey et al. | |
| 5,429,374 A | * | 7/1995 | Eichenberger | 277/552 |
| 6,227,547 B1 | * | 5/2001 | Dietle et al. | 277/336 |
| 6,520,253 B2 | * | 2/2003 | Calder | 166/84.4 |

OTHER PUBLICATIONS

International Search Report for International Application No. PCT/US02/40876, 4pp.

* cited by examiner

*Primary Examiner*—Kenn Thompson
(74) *Attorney, Agent, or Firm*—Christie, Parker & Hale, LLP

(57) ABSTRACT

A rotary seal assembly for a rotary support table for use in drilling systems and the like to provide pressurized fluid to a rotary slip assembly disposed within the rotary support table is provided. The rotary seal assembly is designed to be coupled to an existing rotary support table which is used to rotate a drill string, and includes a powered slip that is powered into an engaged position to securely engage a pipe segment, for example, a casing segment. The rotary seal assembly generally comprises a ribbon of expandable material having an outer surface in fluid communication with a source of pressurized fluid, and an inner surface cooperative with a rotary housing, the rotary seal having a plurality of openings capable of communicating fluid between said outer and inner surfaces, wherein the outer seal surface has a surface area greater than the inner surface such that when the pressurized fluid is conducted to the outer surface of the seal a differential pressure between the outer and inner surfaces is created such that the inner surface of the seal is expanded to engage the rotary housing and form an annular fluid duct providing fluid communication between the pressurized fluid source and the rotary housing. A method of operating a rotary table and powered slip assembly utilizing the rotary slip assembly of the current invention is also provided.

30 Claims, 8 Drawing Sheets

ROTARY SUPPORT TABLE

CROSS-REFERENCE TO RELATED APPLICATION(S)

This application claims priority under 35 U.S.C. §119(e) to U.S. Provisional Application Ser. No. 60/342,998, filed Dec. 21, 2001.

FIELD OF THE INVENTION

This invention relates generally to rotary support tables, and more particularly, to a rotary support table having a slip seal arrangement with improved wear and sealing characteristics.

BACKGROUND OF THE INVENTION

In most conventional oil or gas drilling operations, drilling takes place on a drilling platform, which in turn supports a circular rotary table. The rotary table is designed such that it can be moved in a circular fashion via standard electrical or hydraulic motors. The conventional rotary table has a "kelly" which provides the central opening or bore through which passes the drill string. The kelly itself is supplied with a bushing or "kelly bushing," which can be interlocked with a bushing on the rotary table or "master bushing" such that the rotary table can drive the kelly and impart the needed rotational force to the drill string to effect drilling. Such well drilling equipment is conventional and well-known in the art.

To add or remove a joint of pipe from the drill string, wedge devices called "slips", are inserted into the rotary table central opening into a bowl to prevent the drill stem from falling into the well bore. In many conventional drill platforms, placement of the slips is done manually by well personnel. Sometimes the personnel operating the various mechanical devices in proximity to the rotary table are required to remove an entire drill string from the well bore. This is a time consuming process which requires removal of individual lengths of pipe one at a time in order to completely remove the drill string. This removal necessarily requires the personnel to repeatedly disengage the slips or slip assemblies from their operative position of holding the drill string, and back into the operative position when the next section of drill pipe is in position to be removed from the drill string. As a result, at each removal or addition of a length of drill pipe from the drill string, oil well personnel are required to exert a great amount of manual physical labor to remove/replace slips, which is dangerous because of the large forces required, as well as the great amount of weight which is being handled.

To improve the efficiency and safety of the drilling operation, a "power slip" has been developed, which is rotatably retained within a slip bowl to prohibit the slips from vertical movement while the slip bowl rotates with the rotary table about the drill pipe. Such power slip mechanisms include primary components which are arranged in several basic configurations. The main structure is the slip bowl or body which is generally an enlarged support structure having an internal tapered bore. Slip elements are disposed within the bore and when allowed to fall under the force of gravity, wedge radially against the casing so as to prevent the casing from slipping downwardly. The slips and the bowl are configured such that outer surfaces of the slips contact inner surfaces of the slip bowl in sliding friction and can be automatically activated to seize and hold the drill stem when a portion of the drill stem is being added or removed. For example, such power slip arrangements have been shown in U.S. Pat. Nos. 2,570,039; 2,641,816; 2,939,683; 3,210,821; 3,270,389; 3,457,605; 3,961,399; 3,999,260; 4,253,219; and 4,333,209.

Such prior art power slips come in two basic configurations. One in which the power slip is permanently attached to and rotates with the rotary table and one in which the power slip is disconnected from the rotary table when not in use.

Of the first type, U.S. Pat. Nos. 2,641,816 to Liljestrand and 3,961,399 to Boyadjieff are examples. While these power slips do represent an advance over the conventional manually operated slips, most require permanent attachment of a support post or other structure to the rig floor at the side of the rotary table to allow the power slip to be pivoted or raised away from the frill stem. As such, these devices permanently occupy valuable drill floor space despite the fact that during much of the drill time they will not be in use and may interfere with other drilling operations.

However, in most of the early systems of the rotary power slips, a mechanical linkage had to be provided between a stationary fluid cylinder and the rotary power slip housing. In many of the early conventional systems the slip assembly could not be activated at any point in its rotation but required alignment of the stationary fluid cylinder and the rotary housing. As a result the assembly protrudes above the rig floor thus consuming valuable space. The rotary power slips disclosed in U.S. Pat. Nos. 3,999,260 to Stuckey et al. and 4,333,209 to Herst solve this problem by providing expansive seal means on the stationary fluid supply which form a fluid duct with the rotary housing during operation, eliminating the need for a mechanically aligned linkage and reducing or entirely eliminating the need to utilize valuable floor space for the power slip mechanism. However, the expansive seals provided in both of these systems have been found to be prone to leakage and rapid deterioration as a result of rig vibration, affecting the efficacy and alignment of the seal with the rotary housing. In addition, these prior art devices are prone to introducing mud and debris into the seal and pressurizing system, leading to damage of the hydraulic or pressurized air systems.

Accordingly, a need exists to provide improved rotary power slip seals, which have longer wear and more effective seals, and which provide additional protection from mud and debris entering the power slip system.

SUMMARY OF THE INVENTION

Briefly, and in general terms, the present invention is directed to a rotary seal assembly for a rotary support table for use in drilling systems and the like to provide pressurized fluid to a rotary slip assembly disposed within the rotary support table. The rotary seal assembly is designed to be coupled to an existing rotary support table which is used to rotate a drill string, and includes a powered slip that is powered into an engaged position to securely engage a pipe segment, for example, a casing segment. Because the slip assembly is powered into the engaged position by a pressurized fluid system, the rotary portion of the rotary support table must be properly coupled to an external power fluid system using the seal assembly of the present invention.

The rotary support table of the present invention in one illustrative embodiment is directed to a rotary support table and power slip mountable on a rig and including: a rotary housing having a pipe engagement assembly including a central passageway sized for receipt of the pipe segment, the lower pipe engagement assembly including a powered engagement device that is powered to an engaged position to securely and releasably grasp the pipe segment, the lower pipe engagement assembly being in communication with the drive shaft, whereby actuation of the rotary housing assembly causes the lower pipe engagement assembly to rotate. In such an embodiment the lower pipe engagement assembly is powered via an external pressurized fluid power source, which is connected to the rotary housing via the rotary seal assembly of the present invention. The rotary seal assembly including a ribbon of expandable material having an outer surface in fluid communication with a source of pressurized fluid, and an inner surface cooperative with a rotary housing, the rotary seal having a plurality of openings capable of communicating fluid between said outer and inner surfaces, wherein the outer seal surface has a surface area greater than the inner surface such that when the pressurized fluid is conducted to the outer surface of the seal a differential pressure between the outer and inner surfaces is created such that the inner surface of the seal is expanded to engage the rotary housing and form an annular fluid duct providing fluid communication between the pressurized fluid source and the rotary housing. Although any suitable surface difference can be utilized such that a differential pressure is generated between the outer and inner sides of the seal, in one exemplary embodiment the ration is 1:1.02.

In another exemplary embodiment, the rotary seals may be constructed such that the seals further include an outer annular groove formed into the outer seal surface and an inner annular groove formed into the inner seal surface, wherein the plurality of openings are formed between the outer and inner annular grooves, although any shape suitable for forming a fluid tight duct between the seal and the rotary housing may be utilized. Likewise, the seals may be constructed of any material suitable for providing a suitably expandable seal member while providing long-term wear characteristics.

In another exemplary embodiment, the rotary seal system according to the invention includes an interlock control such that the pressurized fluid is prevented from energizing the rotary seal assembly when the rotary housing is rotating.

In yet another exemplary embodiment, the pressurized fluid is constantly pumped through the rotary seal at a pressure sufficient to provide positive fluid flow out of said at least one rotary seal but insufficient to expand said rotary seal to fully sealingly engage the rotary housing such that contaminants are prevented from flowing into the seal assembly and fluid conduits.

Although any suitable number of rotary seals can be utilized in the rotary support table of the current invention, in one exemplary embodiment at least two rotary seals in fluid communication with at least two separate first and second conduits are disposed within the rotary support table. In such an embodiment, one rotary seal is utilized as a slips down seal in fluid communication with a slips down second conduit arranged such that pressurized fluid flowing through the slips down second conduit activates the fluid actuated operator to extend the slip, and the second rotary seal is utilized as a slips up seal in fluid communication with a slips up second conduit arranged such that pressurized fluid flowing through the slips up second conduit activates the fluid actuated operator to retract the slip.

Although a rotary support table having two rotary seals is described above, in another exemplary embodiment, three rotary seals are provided, each in fluid communication with at least three separate first and second conduits, which are disposed within the rotary support table. In such an embodiment, the third rotary seal is utilized as a slips set seal and is arranged such that when the fluid actuated operator has been fully extended or retracted, the pressurized fluid is directed into the slips set second conduit, through the slips set seal to a slips set first conduit arranged in fluid communication with a fluid detector capable of detecting the presence of the pressurized fluid in the slips set first conduit and communicating that presence to an operator.

In still another exemplary embodiment, the rotary seal is arranged in an annular groove formed into the stationary housing. In such an embodiment, the rotary seal may be fixedly mounted in said groove by an o-ring seal.

In still yet another exemplary embodiment, the rotary seal assembly may further include one or more annular wiper seals fixedly mounted in the stationary housing and in cooperative sealing engagement with the rotary housing such that substances are prevented from passing between the wiper seal and the rotary housing. Although any number of wiper seals may be utilized, in one exemplary embodiment, at least two annular wiper seals are utilized and arranged such that the rotary seal lies therebetween.

In still yet another exemplary embodiment, the rotary seal assembly may further include at least one drain conduit arranged adjacent to the rotary seals in fluid communication between a fluid storage tank and the surface of the stationary housing upon which the at least one rotary seal is attached such that any fluid leaking from the rotary seals is recycled back into the pressurized fluid power source system. In such an embodiment, a fluid filter may be arranged between the drain conduit and the storage tank to filter contaminants from the recycled fluid.

In still yet another exemplary embodiment, the rotary support table according to the invention may further include an annular adjustment ring for adjusting the position of the rotary housing in relation to the stationary housing such that the rotary seals fully seal the passage between the fluid conduits within the stationary and rotary housings.

In still yet another exemplary embodiment, the invention includes a method of operating a power slip, wherein the includes utilizing a rotary support table as described in the exemplary embodiments above.

Other features and advantages of the present invention will become apparent from the following detailed description, taken in conjunction with the accompanying drawings which illustrate, by way of example, the features of the present invention.

BRIEF DESCRIPTION OF THE DRAWINGS

These and other features and advantages of the present invention will become appreciated as the same becomes better understood with reference to the specification, claims and drawings wherein:

DETAILED DESCRIPTION OF THE INVENTION

The present invention relates to a continuously passively engaged rotary seal for providing fluid communication between a rotary slip bowl and a stationary slip ring.

Figure 1:
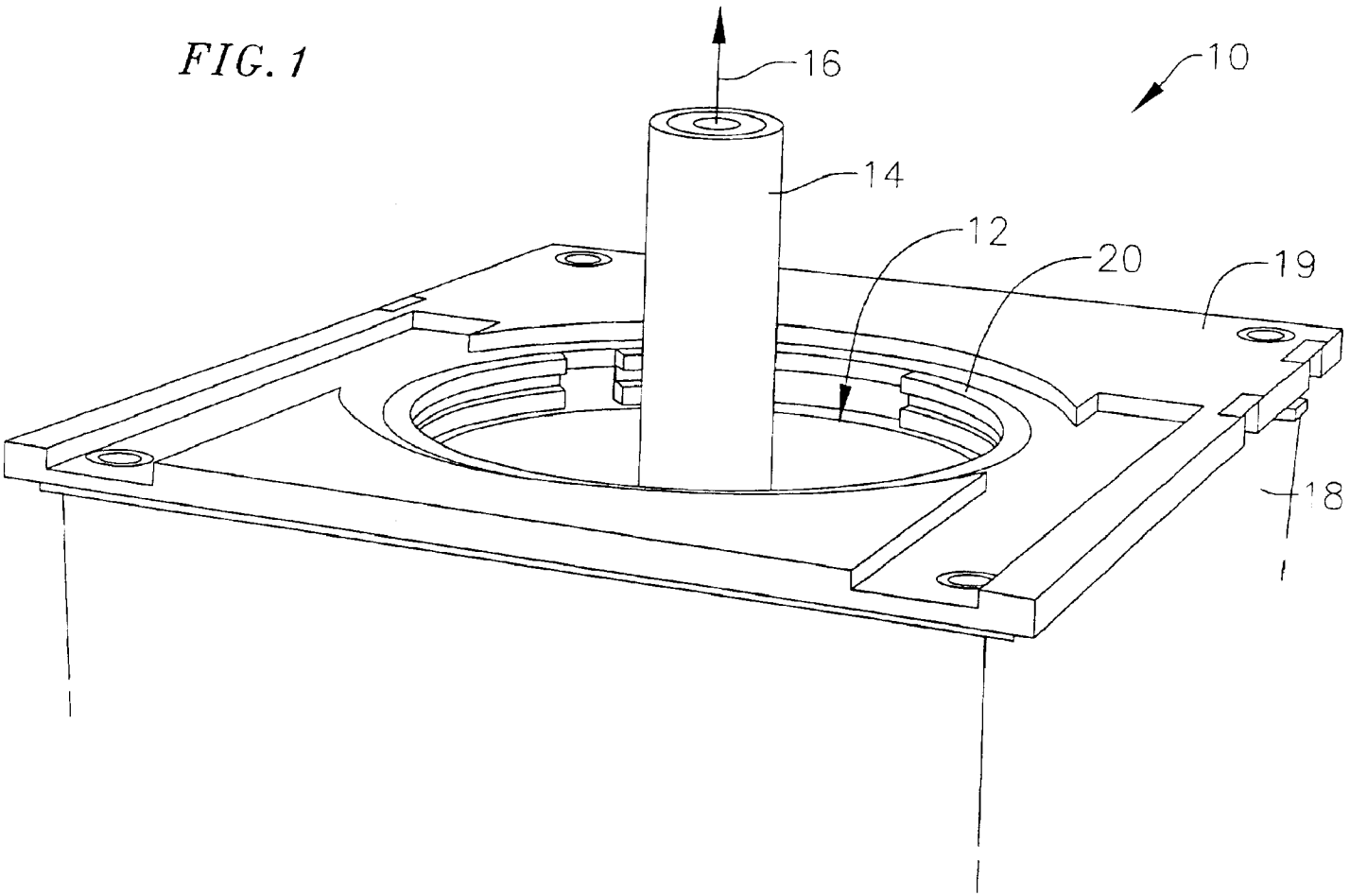
FIG. 1 is a perspective view of a rotary support table according to this invention.

FIG. 1 depicts an outer perspective view of an exemplary embodiment of the invention including a rotary support table 10 defining a central cylindrical opening or bore 12. The central bore 12 being arranged such that a pipe or drill string 14 can be suspended therein and turned about a vertical axis 16 in the central bore 12. The rotary support table 10 further includes an outer stationary housing 18 having a top cover 19 and a rotary slip bowl 20 disposed within the outer stationary housing 18 and arranged coaxially about the vertical axis 16 of the drill string 14 within the central bore 12. A power slip system (not shown) according to the present invention is disposed within the rotary support table 10.

Figure 2:
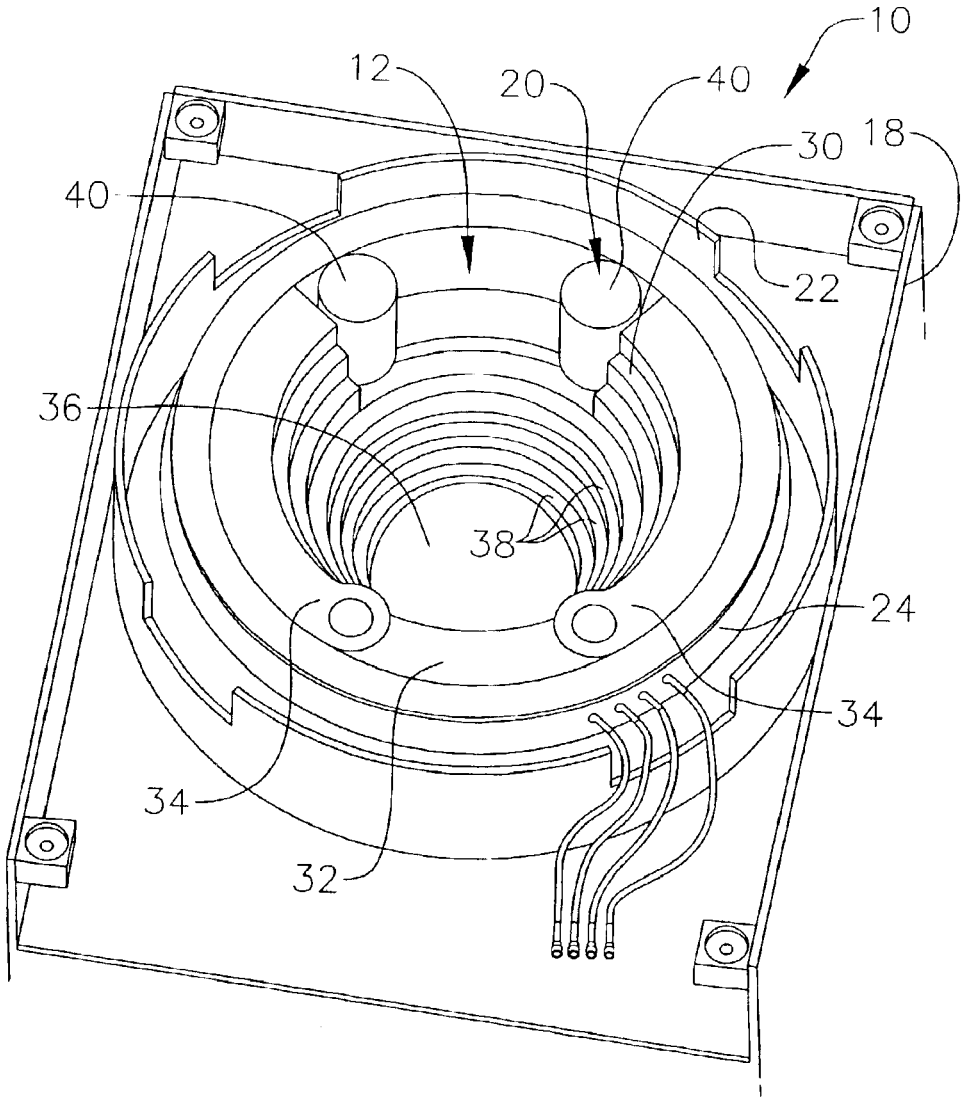
FIG. 2 is a cut-away top view of a rotary support table according to this invention.
Figure 3:
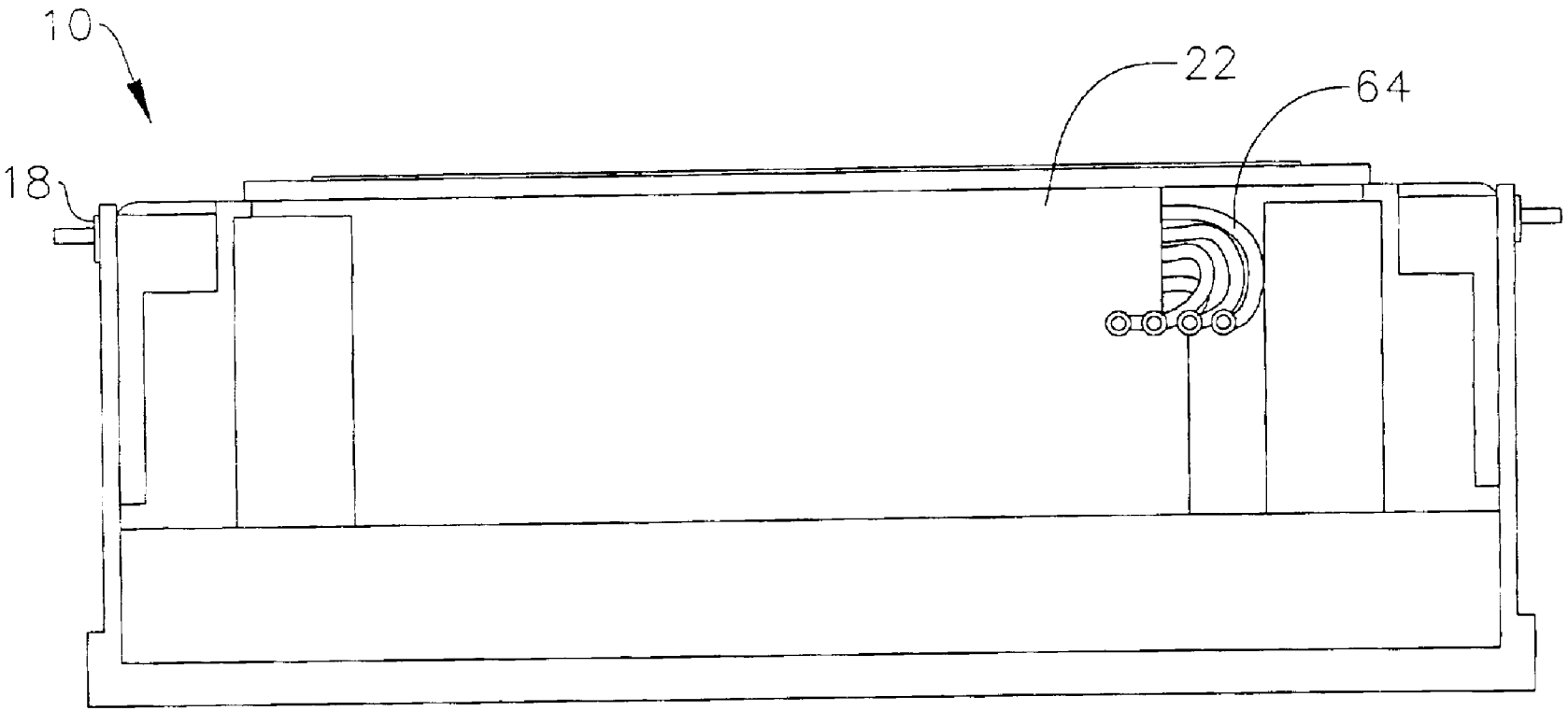
FIG. 3 is a cut-away side view of a rotary support table according to this invention.

FIG. 2 depicts a top view of the rotary support table 10 with the top cover removed. As shown, the rotary support table 10 includes an outer stationary housing 18 defining a cylindrical inner surface 22. A slip ring 24 is fixedly mounted to the inner surface 22 of the outer housing 18. The slip bowl 20 is rotatably mounted within the slip ring 24 axially about the central bore 12 such that the slip ring inner surface 26 is adjacent to the slip bowl outer surface 28 creating a seal gap 29 therebetween (shown in FIG. 4). In operation, a slip assembly (not shown) is rotatably disposed within the slip bowl 20. Any suitable slip assembly may be utilized in the slip bowl 20 of the current invention. In most conventional designs the slip assembly includes a plurality of slips having tapered outer walls that are adapted to engage the tapered inner wall 30 of the slip bowl 20 such that the slip assembly is prevented from lateral, but not rotational movement within the slip bowl 20. Conventionally, each slip carries along its inner surface an engaging insert designed to gripingly engage the drill string to prevent it from falling into the central bore 12.

With reference to FIG. 2, any slip bowl 20 suitable for engaging the inner surface 26 of the slip ring 24 and the outer surface of a slip assembly can be utilized with the inventive seals. In one exemplary embodiment the slip bowl 20, shown in FIG. 2 includes an arc-shaped center section 32 hinged between a pair of arc-shaped side sections 34 and to form a partially enclosed annular body. In such an embodiment, each section is preferably cast from CMS 02 grade 150-135 steel, or more preferably CMS 01 steel, or most preferred CMS 02 grade 135-125 steel, and includes an outer surface, and an upwardly tapered inner surface 30. The sections are symmetrically disposed about a vertical axis to form a central bore 36 for receiving a slip assembly.

Internally, the slip bowl 20 should be configured to retain a slip assembly from lateral movement while enabling the slip assembly to rotate within the bowl against the frictional contact between the slips and the bowl. In one exemplary embodiment, shown in FIG. 2, the tapered inner surfaces 30 of the slip bowl 20 are corrugated to form a plurality of grooves 38 that extend into the central bore 12. The grooves are defined by their tapered contact surfaces which are adapted to engage the outer surfaces of the slip assembly.

Referring to FIG. 2, the sections 34 of the slip bowl 20 are hinged at opposite ends of the center section 33 about a plurality of hydraulic actuators 40, which swing the sections of the slip bowl 20 between an "open" position and a "closed" position. In the open position, the side sections 34 are swung "open" to receive the slip assembly within the central bore 12. In the closed position, the side sections 34 are swung closed to retain the slip assembly within the bowl's central bore 12. An arc-shaped door may be removably coupled between open ends of the side sections of the slip bowl 20 to retain the side sections 34 in their enclosed "closed" positions and form an enclosed annular body that retains the slip assembly.

Although any conventional slip assembly may be utilized in the current invention, most conventional slip assemblies include a generally annular body formed by a plurality of slips. The slips are generally symmetrically disposed about the vertical axis 16 (FIG. 1) of the bore hole 12 to form an orifice 36 (FIG. 2) for receiving the drill string 14. The slips may be made of any suitable material, but in one exemplary embodiment, the slips are cast from CMS 02 grade 150-135 steel or CMS 01 steel. The slips may be hinged such that the opposite ends of the slip assembly can be brought into abutment by a plurality of hydraulic rams that bias the ends of the slips towards each other. The slip assembly may also include a means coupled to the slip assembly which locks the slips into engagement to "close" the slip assembly or to retain the ends of the slips in abutment and form an enclosed orifice to allow insertion of a drill stem 14 therein.

Any slip design suitable for engaging and holding a drill stem 14 within the central bore 12 may be utilized in the current invention, such as, for example, the Varco BJ® PS 21/30 power slip system. In one conventional design, each slip has an arcuate body shape defined by a radial interior surface and a downwardly tapered exterior surface. In any embodiment, the interior surfaces of the slips must be adapted to receive an insert that extends essentially cylindrically about a central orifice to grip and support a pipe 14. The inserts may further include teeth for assuring effective gripping engagement with a pipe 14. For example, the tapered exterior surface of the slips may be corrugated to form a plurality of fingers that outwardly extend from the slip's body. In such an embodiment, the fingers are defined by their tapered contact surfaces which are adapted to engage the inner contact surfaces 30 of the slip bowl 20. The fingers are configured to retain the slip from lateral movement with the bowl 20 while the bowl 20 rotates about the slips against the sliding friction generated between the contact surface 30 of the bowl 20. Regardless of the slip design utilized, under normal operating conditions, the slips must be capable of supporting lateral loads of about 300 tons to about 600 tons. Since cold welding between the slips and the bowl 20 is caused in part by the use of similar steels used in casting the slips and the slip bowl 20, it is desirable that either the slips or the slip bowl 20 is cast from a material dissimilar to steel, namely a material that has little or no tendency to dissolve into the atomic structure of steel (For example). But casting the slips or bowl 20 out of a material other than steel requires specialized hardware and is more expensive to fabricate than steel. Thus, it is desirable to coat the steel slips or the bowl 20 with a dissimilar material along its contact surfaces, such as, for example, copper, a bronze alloy, such as NiAlCu, Tungsten Carbide, Mounting bracket 50 or any other metal in the nickel, aluminum or bronze family.

Figure 4:
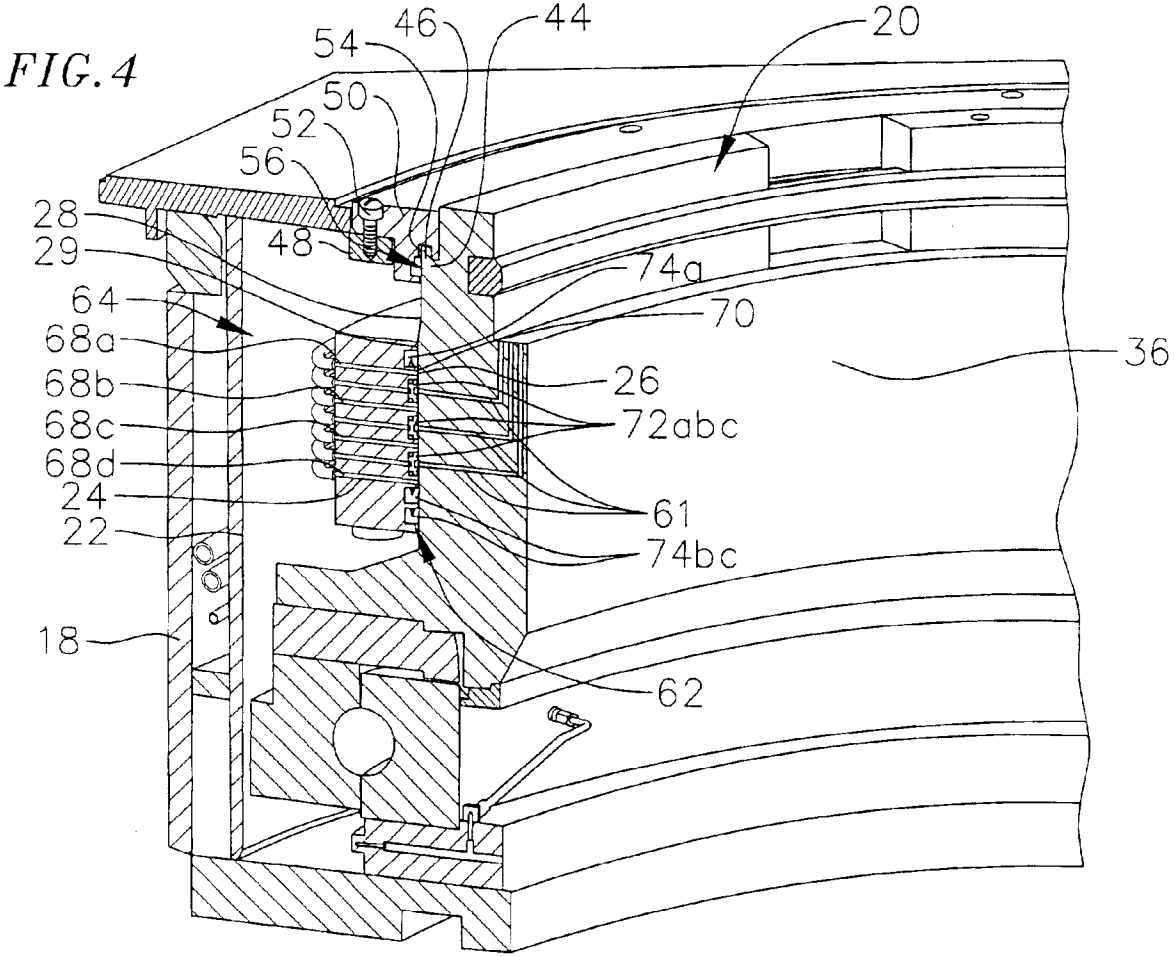
FIG. 4 is a close-up cut-away side view of a rotary support table according to this invention.
Figure 5:
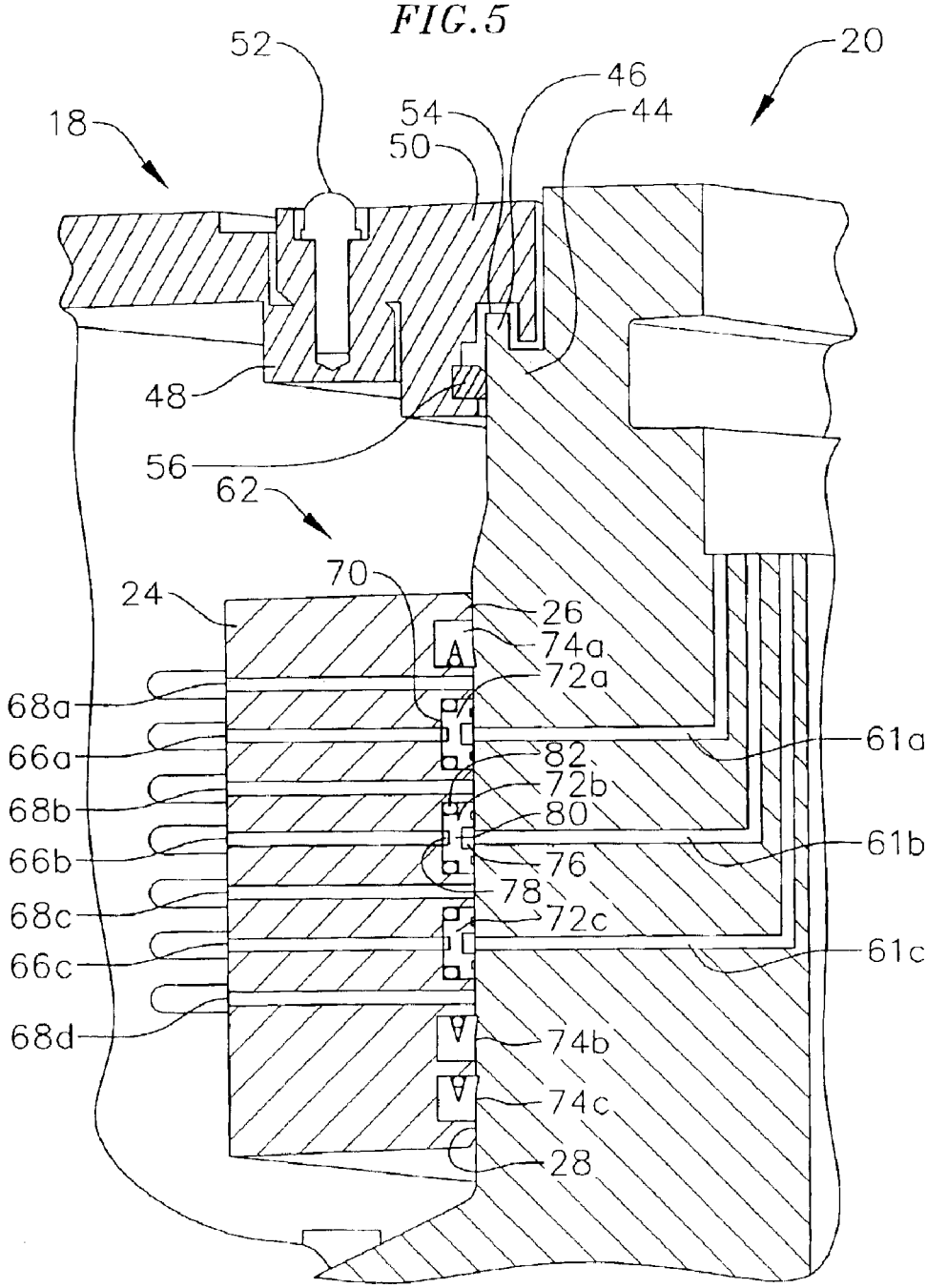
FIG. 5 is a cross-sectional side view of a rotary support table according to this invention.

As shown in FIGS. 4 and 5, in the exemplary embodiment, the outer surface 28 of the slip bowl 20 is defined by a cylindrical shoulder 44 that outwardly extends from an upper portion of the slip bowl 20. A reduced diameter outer cylindrical slip ring engaging member 46 is disposed on the shoulder 44 of the slip bowl 20. The inner surface 22 of the outer housing 18 is also defined by a cylindrical shoulder 48 that outwardly extends from an upper portion of the outer housing 18. A cylindrical top gap element 50 is adjustably attached to the inner wall 22 of the stationary housing 18 via adjustment screws 52 which allow the cylindrical top element 50 to be moved vertically relative to the slip bowl 20. The cylindrical top gap element 50 includes a slip bowl engaging groove 54, which outwardly extends from shoulder 48 of the outer housing 18 such that the outer cylindrical slip ring engaging member 46 of the slip bowl 20 rotatingly engages the adjustable top gap element 50. The top gap element 50 further includes a slip bowl seal 56 designed to sealingly engage the outer surface 28 of the slip bowl 20 such that contaminants and debris are prevented from entering the seal gap 29 between the slip ring 24 and the slip bowl 20. Although one potential means of sealing the gap 29 between the slip bowl 20 and the slip ring 24 is shown in FIG. 4, and described above, any suitable means of preventing mud, drilling fluids or other debris from entering the seal gap 29 and fouling the slip ring 24 or slip bowl 20 could be utilized with the slip assembly of the current invention.

Figure 6:
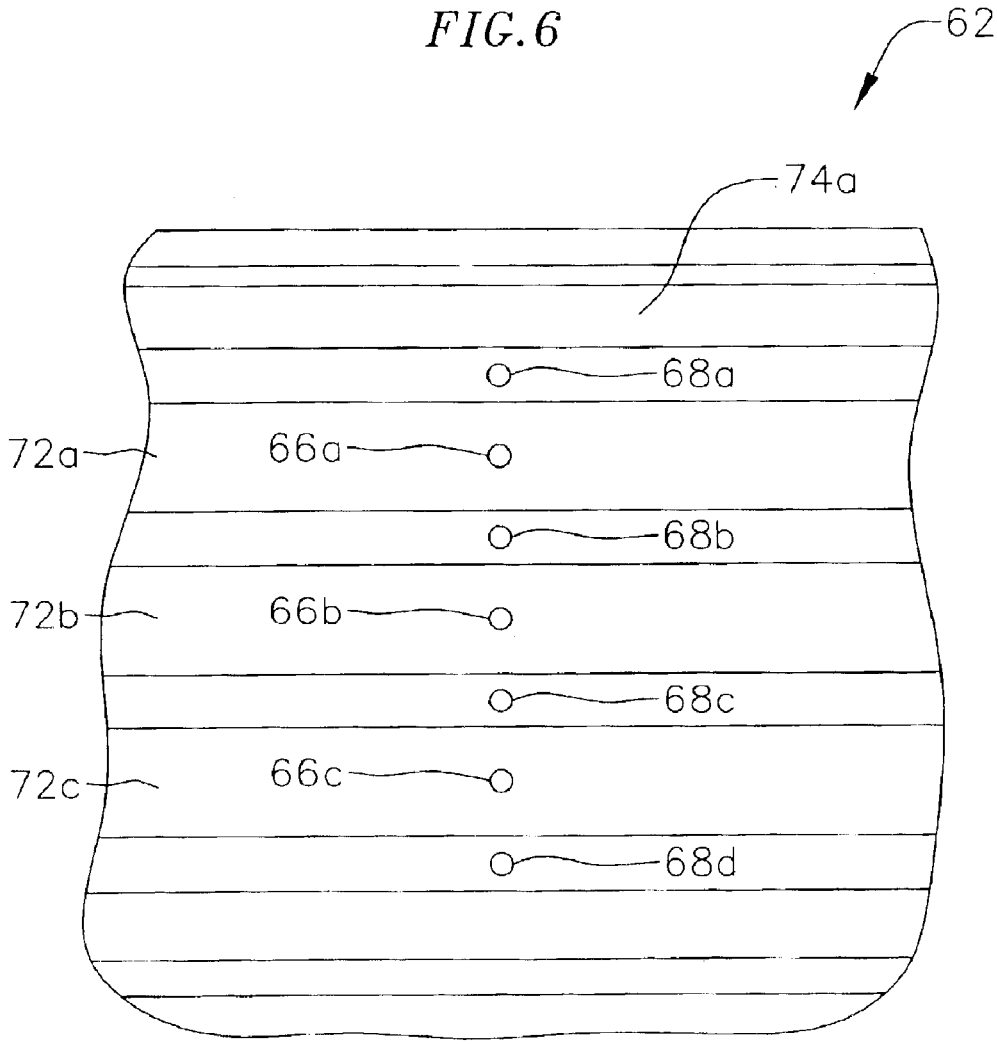
FIG. 6 is a front view of a set of rotary seals according to this invention.

As shown in FIGS. 6 and 5, the hydraulic actuators 40 in the rotary slip bowl 20 are connected to a stationary power source external to the outer housing 18 through slip bowl inlets 61 via a rotary slip ring seal assembly 62 arranged cylindrically around the circumference of the inner surface 26 of the slip ring 24. As shown, the slip ring seal assembly 62 substantially fills the seal gap 29 between the slip ring 24 and the slip bowl 20. The rotary seal assembly 62 is in turn in fluid communication with a power source via a plurality of external lines 64 disposed within the body of the outer housing 18. As best shown in FIGS. 4 to 6, the rotary slip seal assembly 62, includes a cylindrical annular body with a plurality of sets of hydraulic inlets 66*a*, 66*b* and 66*c* in fluid communication with the outlet of the fluid power supply and outlets 68*a*, 68*b*, 68*c* and 68*d* in fluid communication with the filter storage tank inlet of the power supply disposed thereupon. Each set of inlets 66 is arranged within an annular groove 70. Within each annular groove 70 is received an elastomeric slip ring communication seal 72*a*, 72*b*, 72*c* arranged and designed to sealingly engage a predetermined slip bowl inlet 61, 61*b* and 61*c*. In addition to the communication seals 72, the rotary slip seal assembly 62 further includes a plurality of annular wiper seals 74*a*, 74*b* and 74*c*.

The wiper seals 74*a*, 74*b* and 74*c* are designed to provide a wiping seal with the outer surface 28 of the rotary slip bowl 20 such that the hydraulic communication seals 72, the inlets 66 and the outlets 68 disposed between the wiper seals 74 are kept free from foreign substances. The wiper seals 74*a*, 74*b* and 74*c* can include any seal design suitable for providing fluid sealing means across the gap between the outer surface 28 of the rotary slip bowl 20 and the inner surface 26 of the slip ring 24. For example, the wiper seals 74 could include conventional resilient polymer o-ring-type seals which apply a continuous and steady fluid sealing pressure against the outer surface 28 of the slip bowl 20. Although three wiper seals 74*a*, 74*b* and 74*c* are shown in the exemplary embodiments depicted in FIGS. 4 to 7, any number of wiper seals 74 may be used such that the area of the slip ring 24 containing the communication seals 66 are kept substantially free of foreign contaminants and fluid within the area bounded by the wiper seals 74 is kept substantially within that area.

One exemplary embodiment of the hydraulic communication seals 72 are shown in detail in FIG. 5. As shown, the hydraulic communication seals 72 include a ribbon of elastomeric material having inner 76 and outer 78 annular grooves running on opposite sides of a seal wall 80. The outer edges of each seal 72 are held within the groove 70 of the slip ring 24 and sealed by a groove engaging member 82, which resiliently engages and attaches the seal 72 within the groove 70 such that fluid applied to the outer surface 78 of the seal 72 is directed through the communication seal inlets 66 and simultaneously prevented from leaking around the edges of the seal 72. The groove engaging member 82 may include any annular member suitable for sealingly attaching the seals 72 within the grooves 70. In one embodiment, for example, the engaging member is a conventional elastomeric o-ring designed to fit around the circumference of the slip ring 24 within the annular groove 70 and resiliently press the seal 72 within the groove 70.

As shown in FIG. 5, the surface area of the outer annular groove 78 is made smaller than the surface area of the inner 76 annular groove such that when pressurized with hydraulic fluid from the hydraulic power source, a differential pressure is established between the hydraulic fluid on the inner and outer side of the seal wall 80. This differential pressure creates a differential force on the inner side of the seal wall 80 such that the inner seal surface of the elastomeric hydraulic communication seal 72 is engaged against the outer wall of the slip bowl 28. When sufficient pressure is exerted on the outer surface of the seal 78, a fluid sealed passage can be formed between the seal 72 and the outer surface of the slip bowl 28 by the inner annular groove 76 of the seal 72 such that the hydraulic fluid from the power source 60 can flow through the seal inlets 66 into the inner annular groove 76 and then through the slip bowl inlets 61 to activate the hydraulic rams in mechanical communication with a slip assembly. Although any differential size between the inner 76 and outer 78 annular grooves sufficient to create a differential pressure to press the inner surface of the seal 72 against the outer surface of the slip bowl 28, in one exemplary embodiment the inner seal surface has a surface area of 186 inches$^2$ and the outer seal surface has a surface area of 190 inches$^2$, for a ratio of 0.9. In one exemplary embodiment of the invention, the inner seal surface 76 has dimensions of 3.14×59×1 inches and the outer seal surface 78 has dimensions of 3.14×59×0.5 inches and the inlets 66 include holes having diameters of 0.25 inch. Although specific suitable dimensions for both the seals 72 and the inlet holes 66 are described above, it should be understood that any dimensioned seals and holes may be utilized such that a differential pressure is created from the outside of the seal to the inside such that the inside surface of the seal is suitably sealingly engaged against the outer surface of the slip bowl.

As shown in FIG. 6, the hydraulic inlets 66 and outlets 68 are arranged around the circumference of the seals 72 within the inner annular grooves 76 such that hydraulic fluid can be evenly distributed within the entire circumference of the inner groove 76 such that an exact alignment of the hydraulic inlets 66 and the slip bowl inlets 61 is not required.

Figure 7:
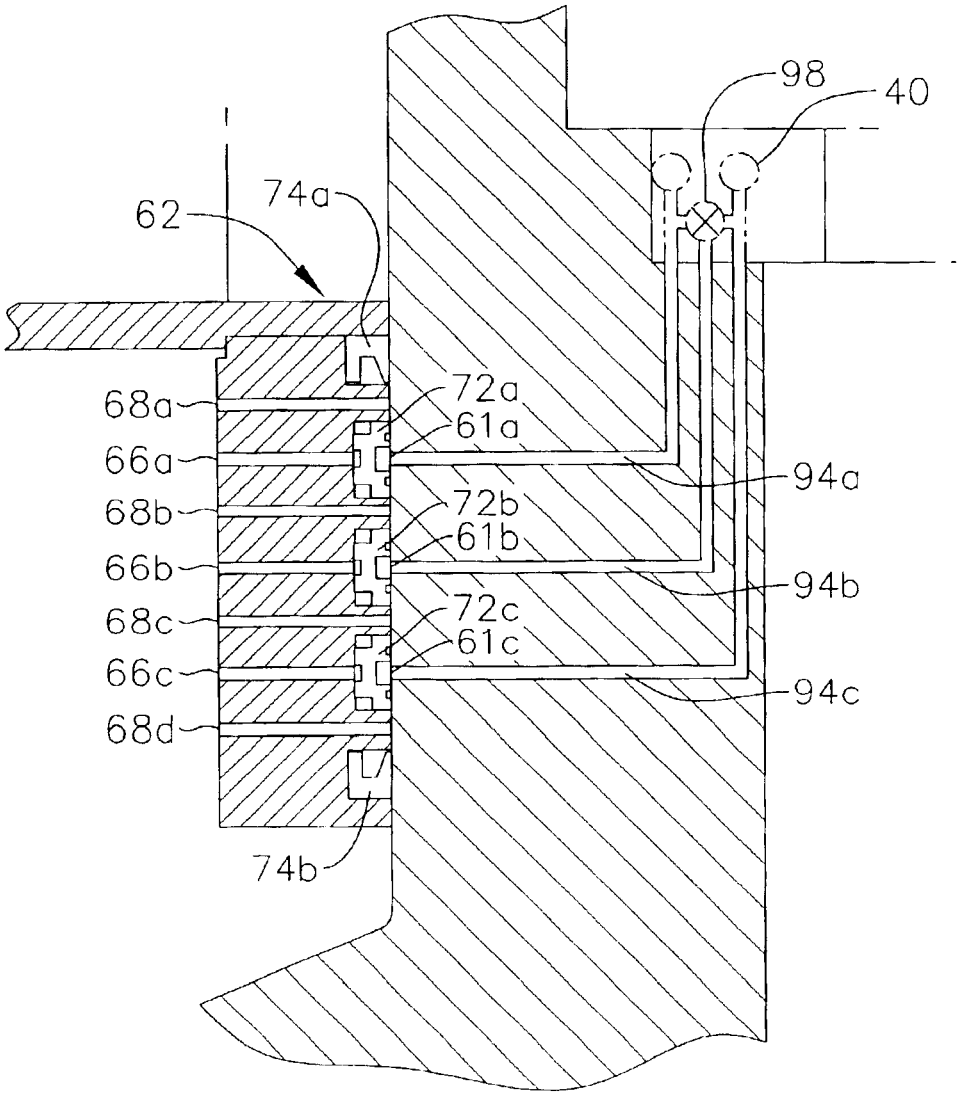
FIG. 7 is cross-sectional sideview of a hydraulic system according to this invention.
Figure 8:
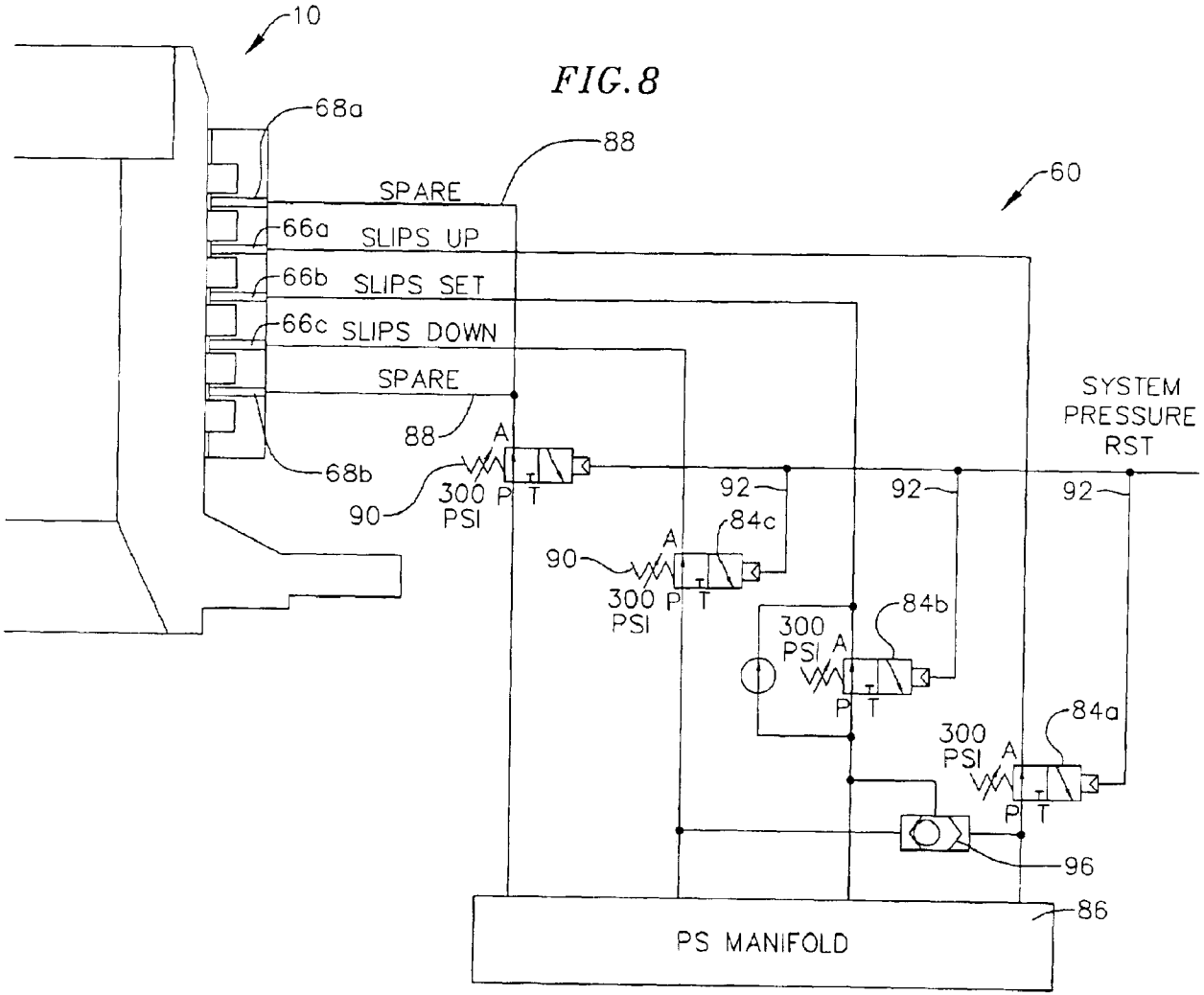
FIG. 8 is an operational schematic of a power slip hydraulic system according to this invention.

FIGS. 7 and 8 show schematic diagrams of one exemplary embodiment of the hydraulic power supply and control system according to the invention. As shown in FIG. 8, the hydraulic seal inlets 66*a*, 66*b*, and 66*c* are connected through hydraulic tubing 64 to a series of control valves 84*a*, 84*b* and 84*c* which in turn connect the inlets to a hydraulic power source manifold 86. Hydraulic seal outlets 68*a*, 68*b* and 68*c* are connected through hydraulic drain lines 88 to the hydraulic power source manifold 86. The control valves 84 are powered via valve power supply 90 and are hydraulically interlocked via interlock lines 92 to the system pressure of the rotary support table 10, such that the control valves 84 cannot be opened to pressurize the hydraulic seal inlets 66 during rotation of the slip bowl 20.

As shown in FIG. 7, the slip bowl 20 is connected to this external fluid power supply 60 via internal slip bowl conduits 94 disposed within the slip bowl and in fluid communication between the slip bowl inlets 61 and the actuators 40 (shown schematically here).

In one embodiment, as shown in FIG. 8, the hydraulic system further includes a shuttle valve 96 which connects the hydraulic power source 60 to the slips set control valve 84*b* such that the slips set control valve 84*b* is activated automatically when either the slips up 84*a* or slips down 84*c* valves are opened. In this embodiment, the hydraulic power system further includes a pressure sensitive slips set check valve 98 (FIG. 7) disposed within the slip bowl 20 and in fluid communication with all of the slip bowl conduits 94 such that upon full engagement or disengagement of the slips from the drillstem by the actuating rams and the subsequent rise in pressure that results as pressurized fluid continues to build up within the conduits 94 once the actuating ram has completed its travel, the check valve 98 opens allowing pressurized fluid to flow out through the slips set conduit 94*b* to a sensor in the slips set control valve 84*b* such that a signal indicating the disengagement or engagement of the rams is communicated to the operator. Any hydraulic lines and control valves suitable for containing the pressurized fluid may be utilized in this invention.

During operation, a pressurized fluid, such as, for example air or hydraulic fluid is constantly applied through the power supply to the inlet of each of the control valves 84. An interlock signal indicative of the rotary table system pressure is also provided to the control valves 84 through the interlock signal lines 92 such that the control valve is incapable of opening during rotation of the rotary slip bowl. Although an engaging pressure is not permitted during rotation because of the interlock, during rotation a constant tank pressure is applied through the lines to the hydraulic seal inlets 66 such that the fluid is constantly flowing out of the seal inlets 66 and against the slip bowl outer surface 28 providing lubrication between the seal 72 and the slip bowl 20 and providing positive flow pressure out of the inlets 66 such that contaminants are not permitted to flow back through the inlets 66 into the hydraulic lines and control valves 84. Excess fluid is trapped within the rotary seal manifold 62 by wiper seals 74 such that the fluid flows through outlets 68 into drain lines 88, is filtered and then directed back into the power supply manifold tank 86.

Referring the FIGS. 7 and 8, during operation of the rams 40 to engage and hold a drill stem in the central bore of the rotary table for either a load-in or load-out procedure, first the rotation of the slip bowl is stopped by an operator. After stopping, the interlock lines 92 automatically indicate that rotation of the rotary table has stopped to the control valves 84. Then the operator can activate the slips down control valve 84*c*. Pressurized fluid then passes through the slips down control valve 84*c* and flows into the outer groove 78 of the slips down hydraulic seal 72*c* such that a differential pressure is created between the outer and inner surfaces of the seal wall 80, thereby energizing the seal 72*c* to resiliently expand inwardly toward the slip bowl to engage the outer surface of the slip bowl. The fluid then flows through the plurality of seal inlets 66*c* around the circumference of the seal 72*c* and into the slip bowl slips down inlets 61*c* disposed about the outer circumference of the slip bowl. The fluid then passes through slip bowl slips down conduit 94*c*, shown in FIG. 8, and into the actuating rams such that the actuators push a set of slips inwardly to engage the drillstem 14.

After the drill stem operation is complete and drilling is to be continued, the operator closes the slips down control valve 84*c* and opens the slips up control valve 84*a*. Pressurized fluid from the power supply manifold 86 then passes through the slips up lines 64*a* to the outer seal groove 78 in the slips up seal 72*a* thereby energizing the seal 72*a* to press against the outer surface of the slip bowl such that the inner groove 76 of the slips up seal 72*a* forms a fluid conduit between the slips up seal inlet 66*a* and the slip bowl sips up inlet 61*a*. The pressurized fluid then passes through the slip bowl slips up conduit 94*a* and into the actuating rams such that the actuating rams are pushed outwardly to disengage the drillstem.

As shown in FIG. 7, the slips up and slips down lines 64*a* and 64*c* are connected to the slips set line 64*b* via a shuttle valve 96 such that when the pressurized fluid passes through one of the lines the shuttle valve 96 is opened to allow pressurized fluid to also energize the slips set seal 72*b* such that the slips set seal 72*b* also engages the outer surface of the slip bowl 28 such that a fluid passage is formed between the slip bowl slips set inlet 61*b* and the slips set seal inlet 66*b*. When the actuating ram has reached its full up or down stroke and the slips are fully set against the drillstem or fully disengaged from the drillstem, the pressure of the fluid inside the slip bowl conduits 94 rises and triggers a slips set check valve 98, which is in fluid communication with both the slips up and slips down conduits 94*a* and 94*c*, to open allowing the fluid to move from the slip bowl slips down or up conduits 94*a* or 94*c* and into the slip bowl slips set conduit 94*b*. The fluid passes outward through the slip bowl slips set inlet 61*b*, in fluid communication with the slip bowl slips set conduit 94*b* and into the slips set seal 72*b*. The fluid then passes through the slips set seal inlets 66*b* and into the slips set line 64*b* such that the fluid interacts with the slips set control valve 84*b* signaling that the rams 40 have either been fully engaged or disengaged, and thus that the associated slips are fully engaged or disengaged from the drillstem, i.e., that the slips are in a "set" position. Once the rams 99 are "set" in the up position, or fully disengaged from the drillstem, the operator can once again start rotation of the rotary slip bowl, which in turn will automatically pressurize the interlock line 92 preventing the activation of the control valves 84 to engage the rams 99.

While several forms of the present invention have been illustrated and described, it will be apparent to those of ordinary skill in the art that various modifications and improvements can be made without departing from the spirit and scope of the invention. Accordingly, it is not intended that the invention be limited, except as by the appended claims.

What is claimed is:

1. A rotary support table comprising:

a stationary housing having at least one first conduit means for transmitting pressurized fluid;

a rotary housing mounted coaxially within said stationary housing for rotation therewith and having at least one second conduit for transmitting pressurized fluid;

at least one rotary seal fixedly mounted in said stationary housing, said rotary seal comprising a ribbon of expandable material having inner and outer surfaces wherein the inner and outer seal surfaces have differential surface areas such that when the pressurized fluid is conducted through the seal a differential pressure is created such that the seal expands to engage the rotary housing and form an annular fluid duct providing fluid communication between the first and second conduits.

2. A rotary support table as described in claim 1, further comprising an interlock control in signal communication with at least one valve for controlling the flow of fluid through the first conduit means such that said valve is prevented from opening when said rotary housing is in a dynamic condition.

3. A rotary support table as described in claim 2, wherein the pressurized fluid is constantly pumped through said at least one rotary seal at a pressure sufficient to provide positive fluid flow out of said at least one rotary seal but insufficient to expand said rotary seal to fully sealingly engage the rotary housing.

4. A rotary support table as described in claim 1, wherein at least two rotary seals in fluid communication with at least two separate first and second conduits are disposed within the rotary support table.

5. A rotary support table as described in claim 4, wherein the two rotary seals consist of:

a slips down seal in fluid communication with a slips down second conduit arranged such that pressurized fluid flowing through the slips down second conduit activates an at least one fluid actuated operator to extend the at least one fluid actuated operator; and a slips up seal in fluid communication with a slips up second conduit arranged such that pressurized fluid flowing through the slips up second conduit activates the at least one fluid actuated operator to retract at least one fluid actuated operator.

6. A rotary support table as described in claim 1, wherein at least three rotary seals in fluid communication with at least three separate first and second conduits are disposed within the rotary support table.

7. A rotary support table as described in claim 6, wherein the three rotary seals consist of:

a slips down seal in fluid communication with a slips down second conduit arranged such that pressurized fluid flowing through the slips down second conduit activates an at least one fluid actuated operator to extend the at least one fluid actuated operator;

a slips up seal in fluid communication with a slips up second conduit arranged such that pressurized fluid flowing through the slips up second conduit activates the at least one fluid actuated operator to retract the at least one fluid actuated operator; and a slips set seal in fluid communication with a slips set second conduit arranged such that when the at least one fluid actuated operator has been fully extended or retracted the pressurized fluid is directed into the slips set second conduit, through the slips set seal to a slips set first conduit arranged in fluid communication with a fluid detector capable of detecting the presence of the pressurized fluid in the slips set first conduit and communicating said presence to an operator.

8. A rotary support table as described in claim 1, wherein the stationary housing further comprises at least one annular groove in fluid communication with the at least one first conduit, the at least one groove being designed such that the at least one rotary seal can be arranged therein.

9. A rotary support table as described in claim 7, wherein the at least one rotary seal is fixedly mounted in said groove by an o-ring seal.

10. A rotary support table as described in claim 1, further comprising at least one annular wiper seal fixedly mounted in said stationary housing and in cooperative sealing engagement with said rotary housing such that substances are prevented from passing between the wiper seal and the rotary housing.

11. A rotary support table as described in claim 9, comprising at least two annular wiper seals arranged such that the at least one rotary seal lies therebetween.

12. A rotary support table as described in claim 1, further comprising at least one drain conduit arranged adjacent to the at least one rotary seal in fluid communication between a fluid storage tank and the surface of the stationary housing upon which the at least one rotary seal is attached.

13. A rotary support table as described in claim 12, wherein a fluid filter is arranged between the drain conduit and the storage tank to filter contaminants from the fluid.

14. A rotary support table as described in claim 12, wherein the at least one valve is in fluid communication with the storage tank.

15. A rotary support table as described in claim 1, further comprising an annular adjustment ring for adjusting the position of the rotary housing in relation to the stationary housing.

16. A rotary support table as described in claim 1, wherein the at least one rotary seal is made of an elastomeric material.

17. A rotary support table as described in claim 1, wherein the rotary housing is made of chrome plated steal.

18. A rotary support table as described in claim 1, wherein the pressurized fluid is hydraulic fluid or air.

19. A rotary support table as described in claim 10, wherein the at least one wiper seal is made of an elastomeric material.

20. A rotary support table as described in claim 1, wherein the at least one rotary seal has a ratio of seal outer surface to seal inner surface of at least over 1:1.

21. A rotary support table as described in claim 1, wherein the at least one rotary seal further comprises an outer annular groove formed into the outer seal surface and an inner annular groove formed into the inner seal surface, wherein the plurality of openings are formed between the outer and inner annular grooves.

22. A rotary support table comprising:

a stationary housing having a first annular opening extending therethrough and having at least one annular groove arranged around the circumference of said annular opening, said stationary housing having at least one first conduit means for transmitting pressurized fluid into said groove and at least one drain conduit for transmitting pressurized fluid out of said annular opening;

a rotary housing having a second annular opening extending therethrough for receiving a drillstem which passes therethrough and into a borehole, the second opening being adapted for mounting coaxially within said first opening in the stationary housing and for rotation therewith and having at least one second conduit for transmitting pressurized fluid;

a fluid actuated operator connected to said rotary housing for rotation therewith and for radially extending and retracting at least one slip, the fluid actuated operator being in fluid communication with the second conduit;

at least one rotary seal fixedly mounted in said at least one annular groove in said stationary housing, said at least one rotary seal comprising a ribbon of expandable material having an outer surface cooperative with the stationary housing and in fluid communication with the at least one first conduit, and an inner surface cooperative with the rotary housing, the at least one rotary seal having a plurality of openings capable of communicating fluid between said outer and inner surfaces, wherein the outer seal surface has a surface area greater than the inner surface such that when a pressurized fluid is conducted through the at least one first conduit to the outer surface of the at least one seal a differential pressure between the outer and inner surfaces is created such that the inner surface of the at least one seal is expanded to engage the rotary housing and form an annular fluid duct providing fluid communication between the at least one first and second conduits;

at least one annular wiper seal fixedly mounted in said stationary housing, said at least one wiper seal having an outer portion fixedly attached to said stationary housing and an inner surface in cooperative fluid sealing engagement with said rotary housing such that a fluid barrier is formed between said wiper seal and said rotary housing; and at least one valve for controlling the flow of fluid through the first conduit means.

23. A rotary seal comprising:

a ribbon of expandable material having inner and outer surfaces and having a plurality of openings, which remain fully open both when the seal is pressurized and when the seal is unpressurized and are capable of communicating fluid between said outer and inner surfaces, wherein the inner and outer surfaces have differential surface areas such that when pressurized fluid is conducted through the seal a differential pressure is created by the inner and outer surfaces such that the inner surface of the seal is expanded to form an annular fluid duct.

24. A rotary seal as described in claim 23, wherein the pressurized fluid is constantly pumped through the seal at a pressure sufficient to provide positive fluid flow out of said rotary seal but insufficient to expand said rotary seal to fully sealingly engage.

25. A rotary seal as described in claim 23, wherein the rotary seal is made of an elastomeric material.

26. A rotary seal as described in claim 23, wherein the pressurized fluid is hydraulic fluid or air.

27. A rotary seal as described in claim 23, wherein the rotary seal has a ratio of seal outer surface to seal inner surface of at least over 1:1.

28. A rotary seal as described in claim 23, wherein the rotary seal further comprises an outer annular groove formed into the outer seal surface and an inner annular groove formed into the inner seal surface, wherein the plurality of openings are formed between the outer and inner annular grooves.

29. A method of applying a power slip comprising utilizing a rotary support table as described in claim 1.

30. A method of applying a power slip comprising:

providing a rotary support table as described in claim 1;

halting rotation of the rotary housing;

supplying a pressurized fluid to the at least one first conduit such that the pressurized fluid flows against the outer surface of the at least one rotary seal such that the at least one seal expands to form a fluid duct which sealingly engages with the at least one second conduit in the rotary housing such that the pressurized fluid flows by the first and second conduits;

operating a fluid actuated operator;

closing the at least one valve to deflate the seal; and restarting rotation of the rotary housing.

* * * * *